US006527020B2

(12) United States Patent
Kanamori et al.

(10) Patent No.: US 6,527,020 B2
(45) Date of Patent: Mar. 4, 2003

(54) OIL SUPPLY STATION SYSTEM

(75) Inventors: Akifumi Kanamori, Tokyo (JP); Kengo Yamazaki, Tokyo (JP); Masahiko Araki, Tokyo (JP)

(73) Assignee: Tatsuno Corporation, Tokyo (JP)

( * ) Notice: Subject to any disclaimer, the term of this patent is extended or adjusted under 35 U.S.C. 154(b) by 0 days.

(21) Appl. No.: 10/067,072

(22) Filed: Feb. 4, 2002

(65) Prior Publication Data

US 2002/0104582 A1 Aug. 8, 2002

(30) Foreign Application Priority Data

Feb. 8, 2001 (JP) ..... 2001-032384

(51) Int. Cl.[7] ..... B65B 1/04

(52) U.S. Cl. ..... 141/104; 141/94; 222/129; 222/23; 222/37; 700/242; 700/238; 705/413

(58) Field of Search ..... 141/98, 104, 192, 141/198, 94, 95; 222/23, 30, 25–29, 36–40, 52, 129; 700/231–244; 705/413

(56) References Cited

U.S. PATENT DOCUMENTS 4,247,899 A * 1/1981 Schiller et al. ..... 705/413
5,867,403 A * 2/1999 Sasnett et al. ..... 700/282
6,036,055 A * 3/2000 Mogadam et al. ..... 222/23
6,089,284 A * 7/2000 Kaehler et al. ..... 141/94

FOREIGN PATENT DOCUMENTS

JP 06-135498 5/1994
JP 07-132997 5/1995

* cited by examiner

*Primary Examiner*—Steven O. Douglas
(74) *Attorney, Agent, or Firm*—Jordan and Hamburg LLP

(57) ABSTRACT

An oil supply station system of the present invention includes a plurality of oil supply apparatuses standing within an oil supply station, and each having at a body case thereof a self-service oil supply mechanism and a touch-activated operating panel and having a printer for recording any change on a slip for a cash transaction. The system further includes a change dispenser disposed in a vicinity of an office of the oil supply station, for reading the slip and discharging change. Also, a POS terminal is connected in a data communicable manner with the plurality of oil supply apparatuses and the change dispenser, for providing permission to the change dispenser to dispense change.

6 Claims, 14 Drawing Sheets

OIL SUPPLYFINISHED

RECEIVE SLIP

FOR PAID 3,000 YEN, 25.8 LIT.
HIGH-OC. GASOLINE SUPPLIED.

THANKS
WAITING FOR
THE NEXT USE

OIL SUPPLY STATION SYSTEM

BACKGROUND OF THE INVENTION

1. Field of the Invention

The present invention relates to an oil supply station system, and in particular to an oil supply station system equipped with an oil supply apparatus of a self-service system that has an oil supply guiding apparatus for guiding an oil supply setup.

The term "oil" as used in the present application means liquid hydrocarbons which function as fuels and lubricants for vehicles powered by internal combustion engines. Therefore, the term "oil" is inclusive of gasoline, motor oil and diesel fuel. An "oil supply station system" of the preset invention dispenses one or more of gasoline, motor oil and diesel fuel.

2. Description of the Related Art

Recent years have observed an increasing number of oil supply stations employing a self-service system for clients to render their own services such as for wiping automobile windows, for labor cost reduction, etc. In such a self-service type oil supply station, clients follow an oil supply guide by indication or voice, such as on or from an oil supply apparatus, to perform key operations for an oil supply setup, before entering oil supply work.

However, the oil supply setup to be performed by clients at an oil supply apparatus in the past had a plurality of setting items allotted to a plurality of keys, and additionally the key indication was small, so that the setup was incomprehensible and took much time for the operation. Moreover, in the case of an oil supply station equipped with a plurality of oil supply apparatuses, as the oil supply was payable in cash needing a change, the provision of change payers installed at or near respective oil supply apparatuses gave a rise to the installation cost, with an increased complexity and degraded operability of oil supply apparatus, in addition to the necessity of a monitoring inadaptive for a few workers to perform.

SUMMARY OF THE INVENTION

The present invention has been achieved with such points in view. It therefore is an object of the present invention to provide an oil supply station system which is equipped with an oil supply apparatus having an oil supply guiding apparatus adapted for items of setup of an oil supply operation guide to be clearly indicated at a single point, with an increased visibility of an operation button and facilitated confirmation, and which is low of installation cost and facile of changing process.

To achieve the object, according to a first aspect of the invention, there is provided an oil supply station system comprising: a plurality of oil supply apparatuses standing within a site of an oil supply station, and each respectively having at a body case thereof an oil supply mechanism adapted for a client to render as own services an oil supply setup and oil supply work, and a touch-panel indicator for indicating an oil supply guide, and having a printer for recording a change on an oil supply slip for oil supply payable in cash; a change payer disposed in a vicinity of a building of an office of the oil supply station, for reading the oil supply slip to discharge a change; and a POS terminal connected in a data communicatable manner with the plurality of oil supply apparatuses and the change payer, for providing a discharge permission of the change to the change payer. It can thus eliminate the need of provision of a plurality of change payers, with a reduced installation cost, allowing for oil supply apparatuses to be improved in operability without increase in complexity, as well as for a monitoring to be performed by a few workers in a building of an office.

Further, to achieve the object, according to a second aspect of the invention, the body case of a respective oil supply apparatus has a human body sensor attached thereto for detecting the client, the touch-panel indicator being adapted to start indication in response to a detection signal of the human body sensor, and an oil supply guiding apparatus is provided to be adaptive by operation confirmation for a sequential indication of setup image frames having a select button disposed every setup item. Accordingly, by provision of a touch-panel indicator attached to the body case for indicating a setup image frame, it is allowed for an oil supply operation guide to be clearly indicated every setup item at a single point, with an increased visibility of an operation button and facilitated confirmation.

According to a third aspect of the invention, the select button of a setup image frame indicated on the touch-panel indicator has a deformed button configuration to indicate a selection when pressed. Because a button configuration is deformed when pressed, the operation confirmation is facilitated.

According to a fourth aspect of the invention, the oil supply station system further comprises a speaker for a voice guide to be performed in correspondence to a setup image frame indicated on the touch-panel indicator. Because a speaker gives a voice guide in correspondence to a setup image frame, it is ensured to perform an operation for each setup item in a short while.

According to a fifth aspect of the invention, the touch-panel indicator has a plurality of still images randomly selected to be indicated thereon one by one at intervals of a constant time during an oil supply waiting period before oil supply or after oil supply. Because a plurality of still images are randomly indicated at constant intervals during an oil supply waiting period, the indication is attractive even before or after oil supply.

According to a sixth aspect of the invention, the touch-panel indicator has, as a background of a setup image frame indicated thereon, one of a plurality of wall paper image frames randomly selected to be indicated up to an end of the oil supply setup. It therefore is possible to randomly change a wall paper image frame, allowing for setup image frames to be indicated without wearing.

BRIEF DESCRIPTION OF THE ACCOMPANYING DRAWINGS

DETAILED DESCRIPTION OF THE PREFERRED EMBODIMENT

Figure 22:
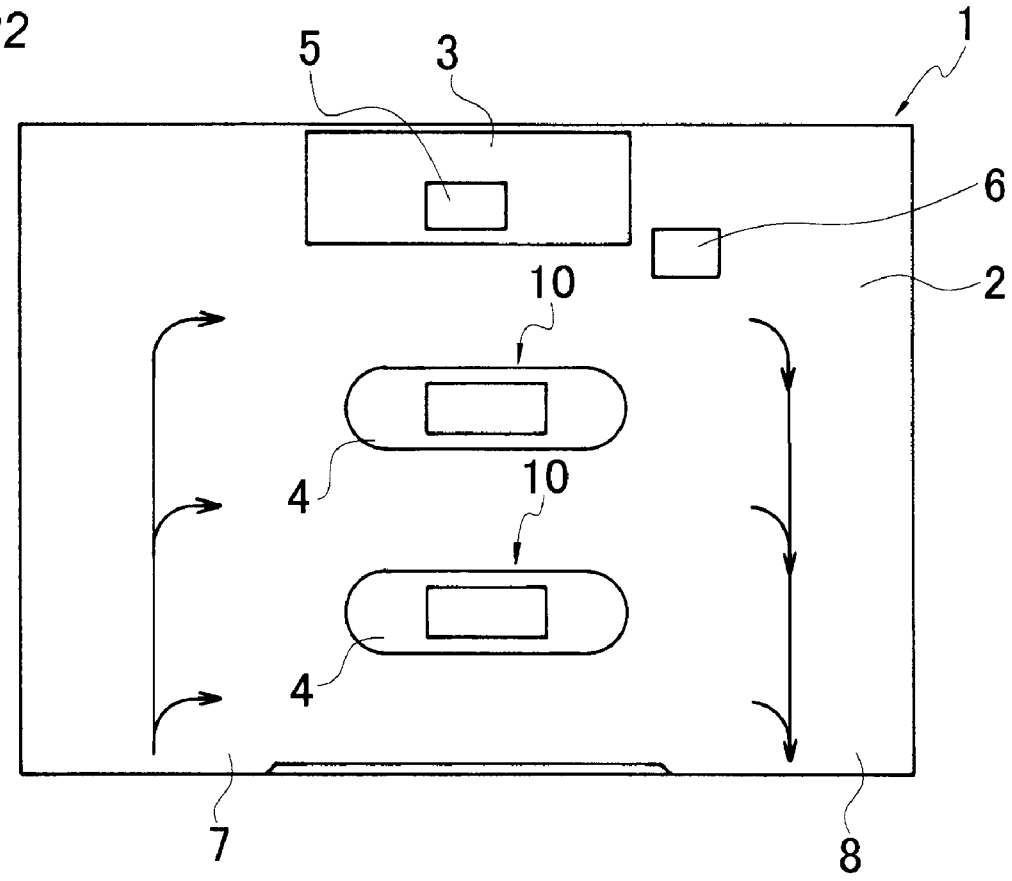
FIG. 22 is a plan view of an oil supply station according to the embodiment of the invention.
Figure 23:
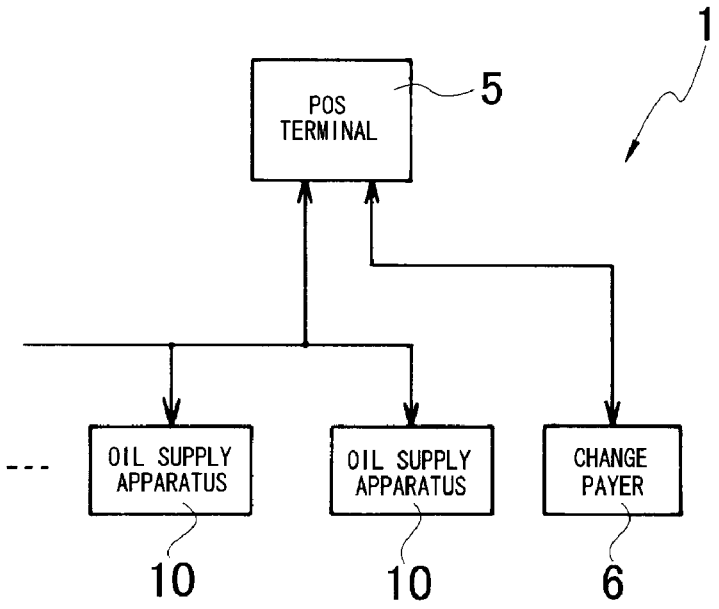
FIG. 23 is a block diagram of essential equipment of an oil supply station system according to the embodiment of the invention.
Figure 24:
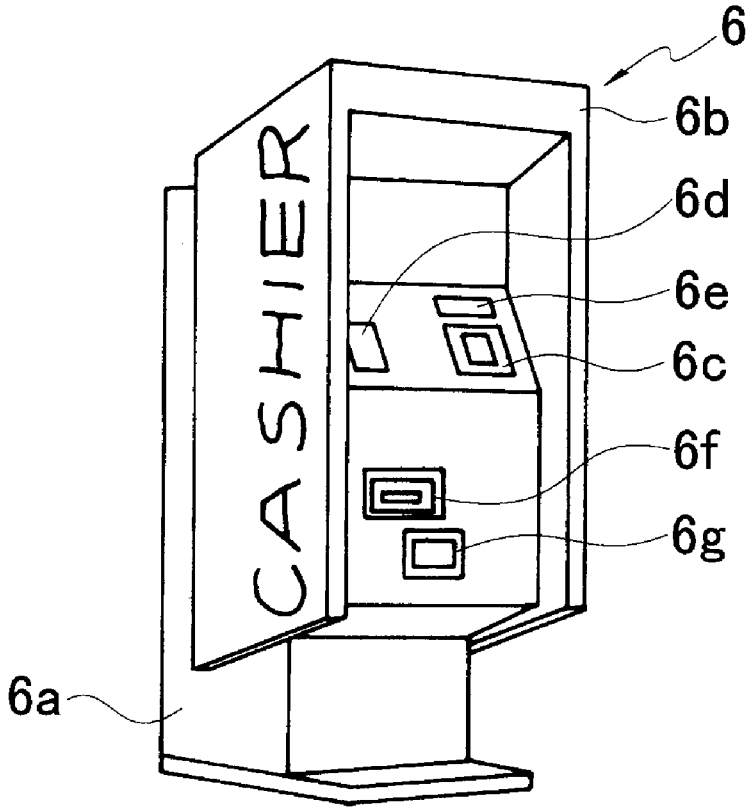
FIG. 24 is a perspective view of a cashier as a change payer according to the embodiment of the invention.

There will be detailed below a preferred embodiment of the present invention with reference to the accompanying drawings. FIG. 22 to FIG. 24 are drawings describing an entirety of an oil supply station system according to an embodiment of the invention, wherein FIG. 22 is a plan of an oil supply station, FIG. 23 is a block diagram of arrangement of essential apparatuses of the oil supply station system, and FIG. 24 is a perspective view of a change payer.

As shown in these Figures, the oil supply station system 1 in the present embodiment includes a POS (point of sales) terminal 5 disposed in a building 3 of an office which is built at a recess end of a site 2 of the oil supply station, a change payer 6 standing within the site 2, in a vicinity of the building 3, and a plurality of oil supply apparatuses 10 respectively standing on islands 4 which are located in a central area of the site 2. The POS terminals 5 are connected in a data communicatable manner with the oil supply apparatuses 10 and the change payer 6 that constitute apparatuses disposed in the oil supply station, and is adapted, particularly in the case of oil supply at any oil supply apparatus 10, as it is payable in cash needing a change, for recording an amount of the change such as in a bar code on an oil supply slip by a printer, and when having read the oil supply slip at the change payer 6, for collating with the oil supply apparatus 10 having served for the oil supply to give the change payer 6 a permission of discharge of the change. As shown in FIG. 24, the change payer 6 has a case as a body 6*a* thereof formed in a box shape, of which a top and left and right sides are covered with a hood 6*b*, and which is provided, in upper part of a front side of the body case 6*a*, with a reader 6*c* for reading the oil supply slip having a change recorded thereon, an indicator 6*e* for indicating data such as read by the reader 6*c*, and an inter-phone 6*d* for communication with a clerk of the office such as when unable to understand how to use, and under them, with a paper money discharge part 6*f* and a coin discharge part 6*g* for discharging a paper money and coins, respectively.

Figure 1:
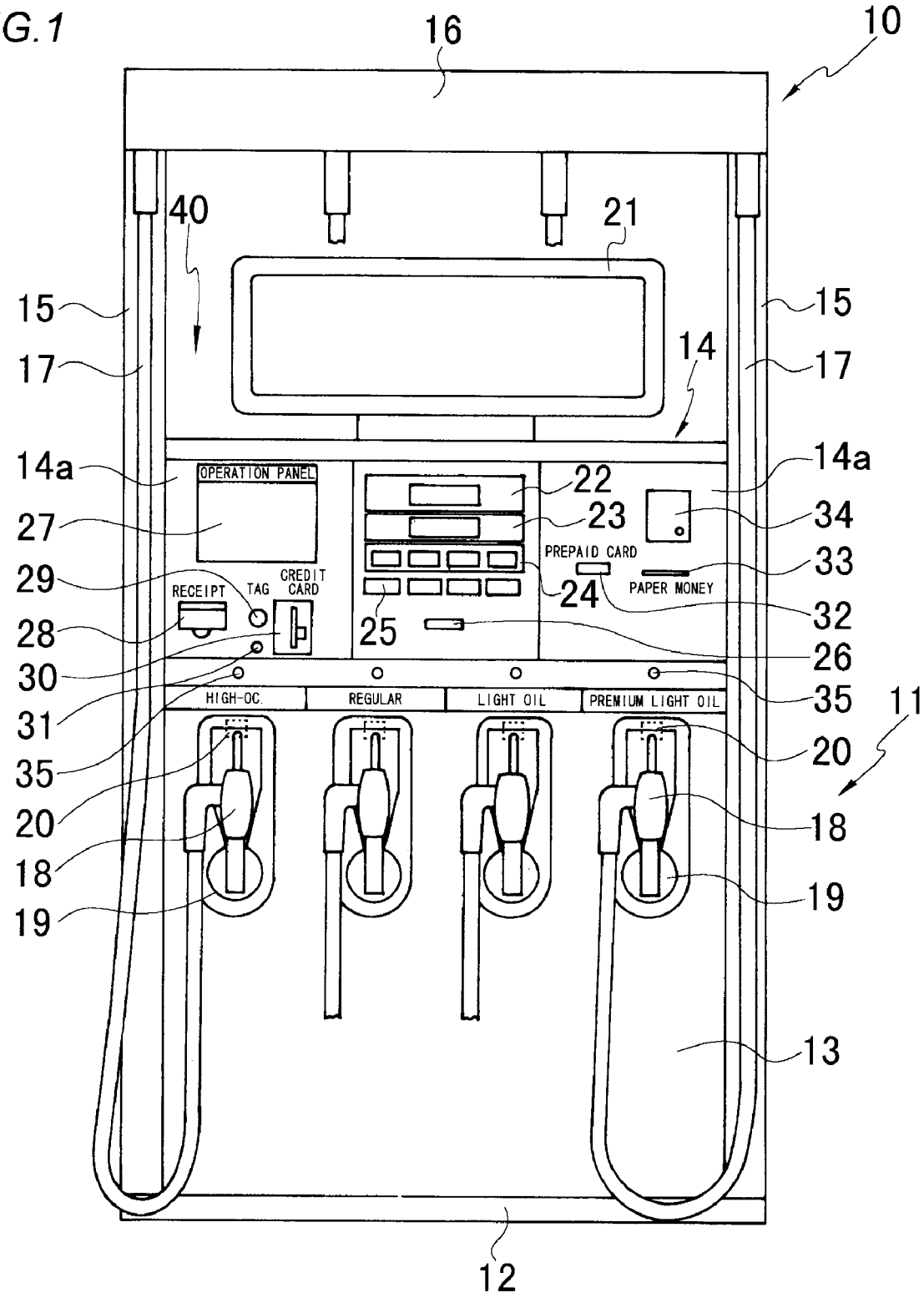
FIG. 1 is a front view of an oil supply apparatus provided with an oil supply guiding apparatus according to an embodiment of the invention.
Figure 2:
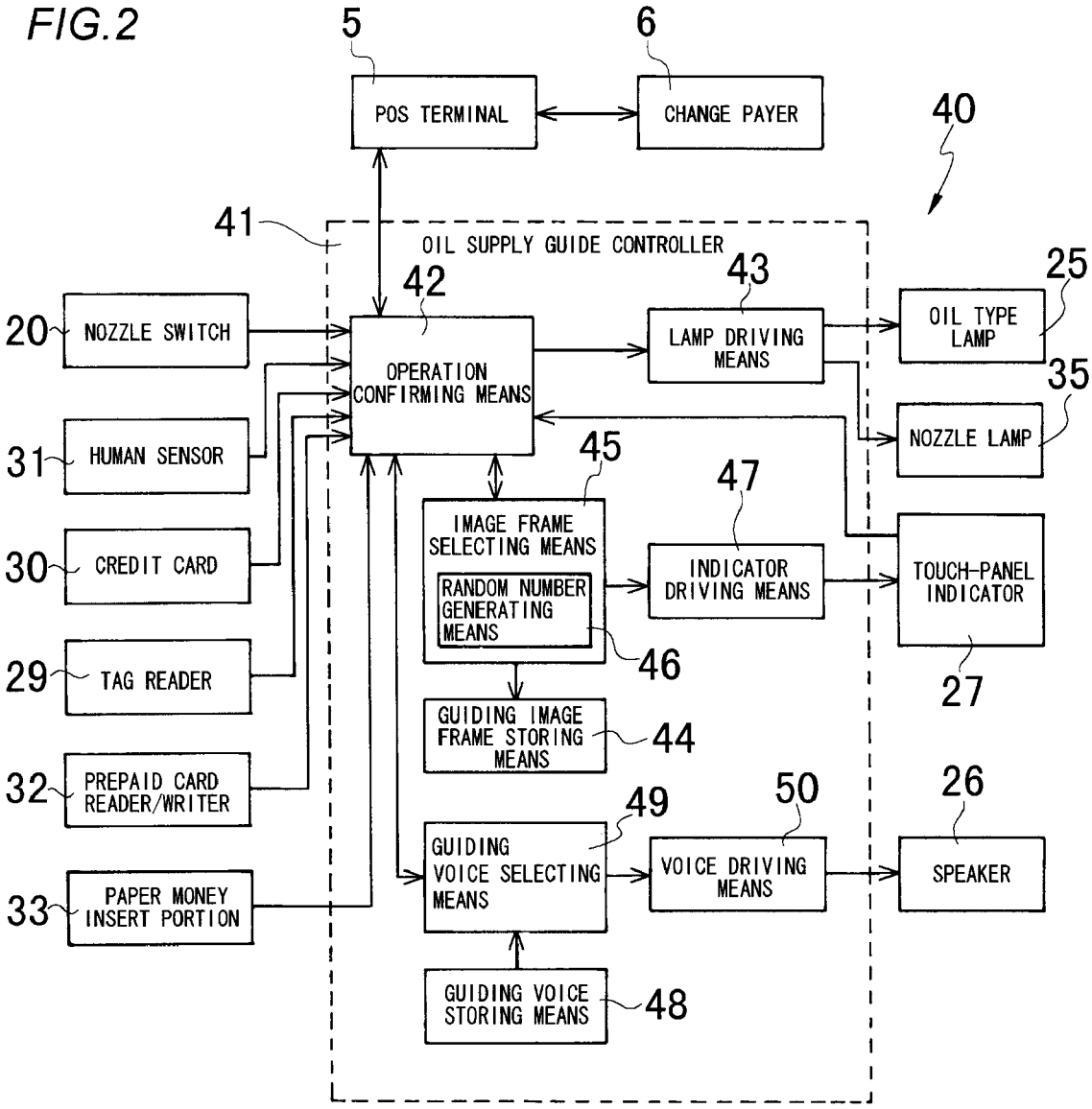
FIG. 2 is a block diagram of arrangement of the oil supply guiding apparatus according to the embodiment of the invention.

FIG. 1 and FIG. 2 are drawings describing an oil supply guiding apparatus in the present embodiment of the invention, where FIG. 1 is a front elevation of an oil supply apparatus provided with the oil supply guiding apparatus, and FIG. 2 is block diagram of constitution of the oil supply guiding apparatus.

As shown in these Figures, the oil supply apparatus 10 in the present embodiment is an on-earth placement type installation which supplies any and all of, for example, a regular gasoline, a high-octane gasoline, a light oil, and a premium light oil, and of which a body case 11 accommodates therein an oil supply mechanism for a self-service of a respective one of the oil types, including an oil supply pump, a flow meter, etc., and is provided with the oil supply guiding apparatus 40 for a guiding of oil supply by indication and/or voice. This oil supply self-service mechanism has, downstream the flow meter, a connection by a piping to an oil supply hose 17 having an oil supply nozzle 18 at the distal end.

The body case 11 is formed, among others, by a lower case 13 for accommodating a plurality of oil supply mechanisms placed on a base plate 12, an upper case 14 disposed thereabove, support posts 15, 15 provided at the left and right of the lower and upper cases 13 and 14, and a top case 16 provided between upper ends of the support posts 15, 15 for hanging a respective oil supply hose 17. The oil supply nozzle 18 is configured to be hung from a nozzle hanger 19 provided at the front side of the lower case 13, and a nozzle switch 20 is provided near the nozzle hanger 19 for detecting the oil supply nozzle 18 hung thereon or removed therefrom. The outside of oil supply nozzle 18 is color coded by oil types, for example, in a color of yellow on the oil supply nozzle 18 for high-octane gasoline. Above nozzle hangers 19, on the upper case 14, there are disposed nozzle lamps 35 that turn on each respectively upon selection of a corresponding oil type. The upper case 14 is formed as a whole in a box shape housing by a frame structure, which housing is divided, at the front side, laterally into (three in the embodiment) sections, of which a respective section has at the front an indication panel 14*a*, as a mold such as of plastic resin, attached thereto to be operative for open and close. As will be detailed later, the indication panel 14*a* is equipped with various apparatuses associated with the oil supply guiding apparatus 40. Further, in a space between the upper case 14 and the top case 16 above it, there is disposed an indication board 21 for indication of a self-service type oil supply apparatus.

An indication panel 14*a* disposed in a central part has thereon an oil supply money amount indicator 22, an oil supply quantity indicator 23, and a unit price indicator 24 composed each respectively of a transparent type liquid crystal display and arranged between from above to central part thereof, and is equipped, under the unit price indicator 24, with an oil type lamp 25 for indication of a selected oil type, and therebelow, with a speaker 26 for outputting an oil supply guiding voice.

An indication panel 14*a* disposed at the left has a touch-panel indicator 27 attached thereto for a colored indication such as an oil supply guide for a respective one of setup items, an information service during oil supply, or a variety of setup buttons, and is equipped therebelow with a printer 28 for issuance of a receipt such as an oil supply slip, a tag reader 29 for reading a tag with recorded information of a particular client, and a credit card reader 30 for reading a credit card, and further below the tag reader 29, with a human body sensor 31 for detecting a client.

An indication panel 14*a* disposed at the right is equipped with a prepaid card reader/writer 32 for reading/writing a prepaid card for payment of an oil supply charge, and a paper money insertion part 33, and further above the paper money insertion part 33, with an inter-phone 34 for communication with the office.

Further, as shown in FIG. 2, the upper case 14 has therein an oil supply guide controller 41 provided as a component of the oil supply guiding apparatus 40 for controlling an operational guide. The oil supply guide controller 41 has: an operation confirming means 42 for detecting actions or operations of the nozzle switch 20, human body sensor 31, credit card reader 30, tag reader 29, prepaid card reader/writer 32, paper money insertion part 33, and touch-panel indicator 27; a lamp driving means 43 for driving the oil type lamp 25 and nozzle lamp 35 to turn on in response to a result of detection of the operation confirming means 42; an image frame selecting means 45 for selecting, to read, an image frame stored in a guide image frame storing means 44 in response to the result of detection of the operation confirming means 42; a random number generating means 46 provided in the image frame selecting means 44 for generating a random number to randomly select a necessary image frame; an indicator driving means 47 for driving the touch-panel indicator 27 to indicate an image frame selected by he image fame selecting means 45; a guide voice selecting means 49 for selecting, to read, a guide voice stored in a guide voice storing means 48 in response to the result of detection of the operation confirming means 42; and a voice driving means 50 for outputting from the speaker 26 a guide voice selected by the guide voice selecting means 49. The image frame storing means 44 has image frames stored therein including a plurality of initial image frames, a setup image frame with provision such as of select buttons, and a plurality of wall paper image frames. One of the plurality of initial image frames is selected in a random manner by the random number generating means 46, to be displayed for a constant time for changeover. Once one of the plurality of wall paper image frames is selected in a random manner by the random number generating means 46, the same is kept displayed up to a finish of setup.

Figure 3:
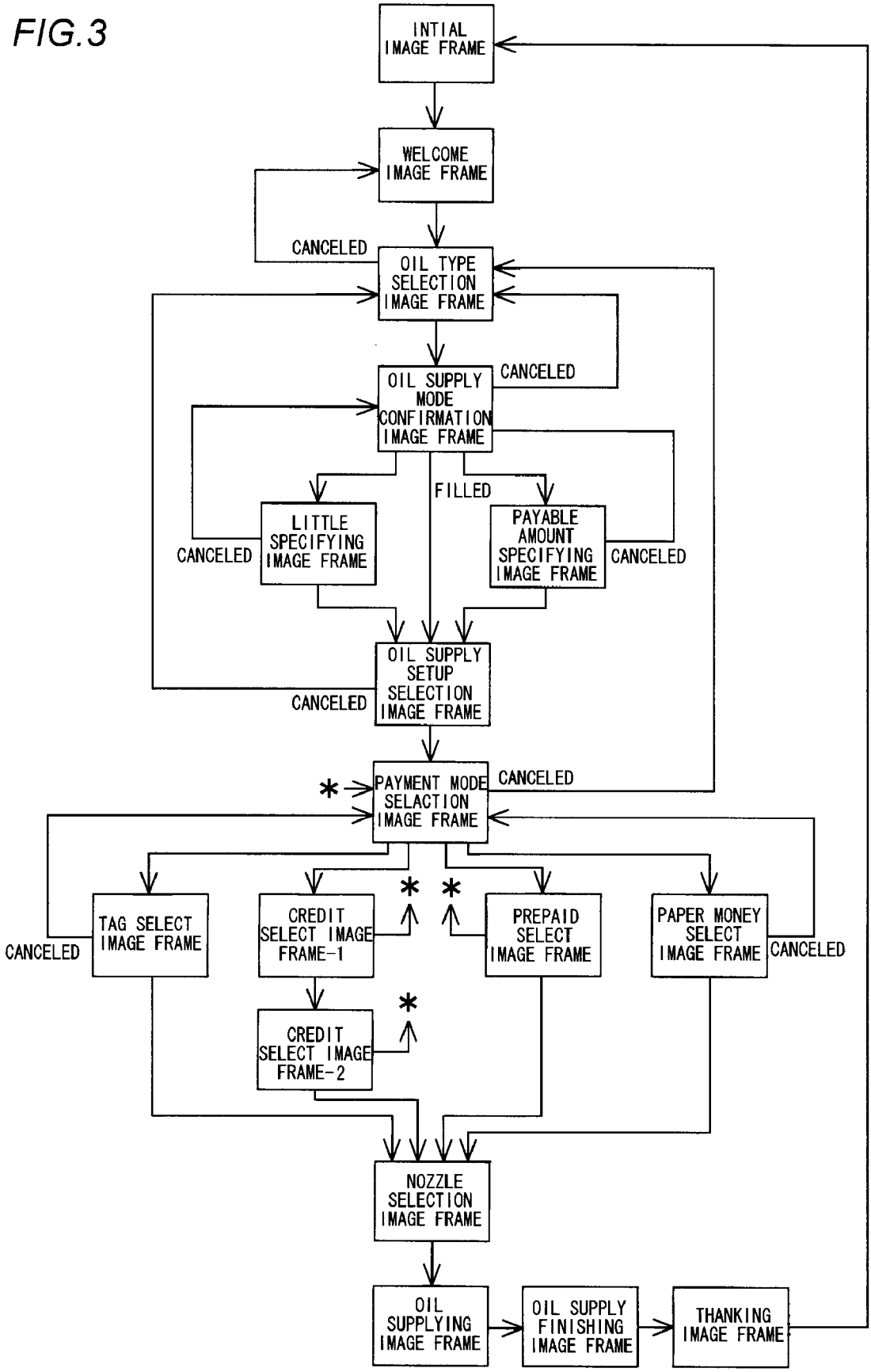
FIG. 3 is a flowchart of indication of the oil supply guiding apparatus according to the embodiment of the invention.

Next, description will be made about exemplary indications on the touch-panel indicator 27 of the oil supply guiding apparatus 40. FIG. 3 is a flowchart of an indication procedure at the touch-panel indicator of the oil supply guiding apparatus, and FIG. 4 to FIG. 21 are illustrations describing exemplary concrete indications.

Figure 4:
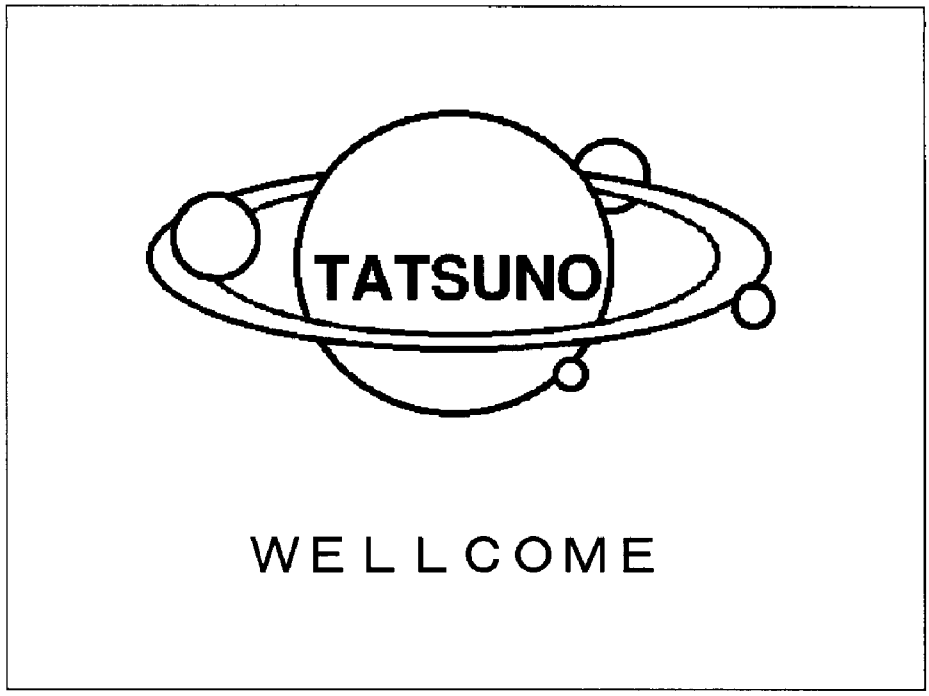
FIG. 4 is an exemplary illustration of an initial image frame according to the embodiment of the invention.
Figure 5:
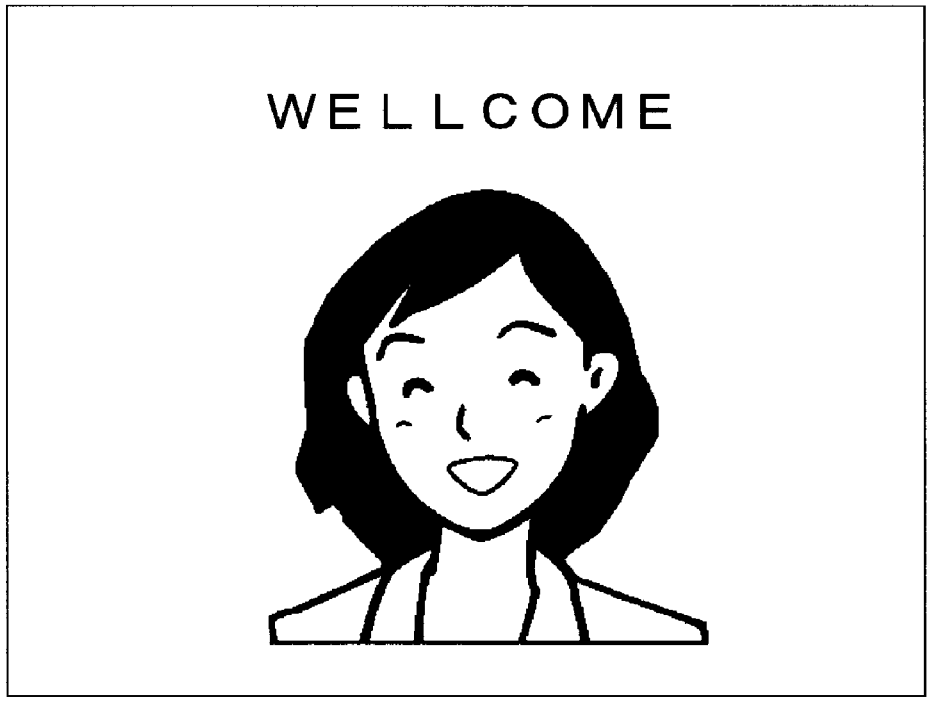
FIG. 5 is an exemplary illustration of a welcome image frame according to the embodiment of the invention.

First, in an oil supply waiting condition of the oil supply apparatus 10, such an initial image frame as shown in FIG. 4 is displayed. The initial image frame is constituted with a plurality of color still images such as an illustration including a letter phrase "WELCOME", and an insert illustration or photograph such as of a scene or animal. The image frame selecting means 45 is adapted, by generation of random numbers by the random number generating means 46, to randomly select one of the plurality of still images to be displayed for constant time by making the indicator driving means 47 drive the touch-panel indicator 27, and again likewise randomly select one of the still images to be displayed for constant time, in a repeating manner.

Figure 6:
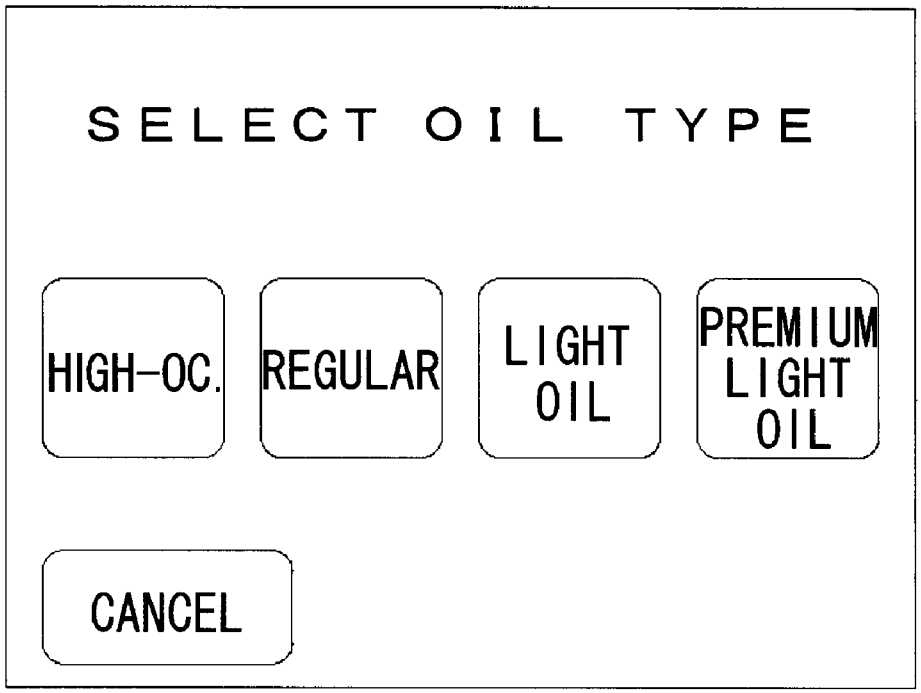
FIG. 6 is an exemplary illustration of an oil type selection image frame according to the embodiment of the invention.
Figure 7:
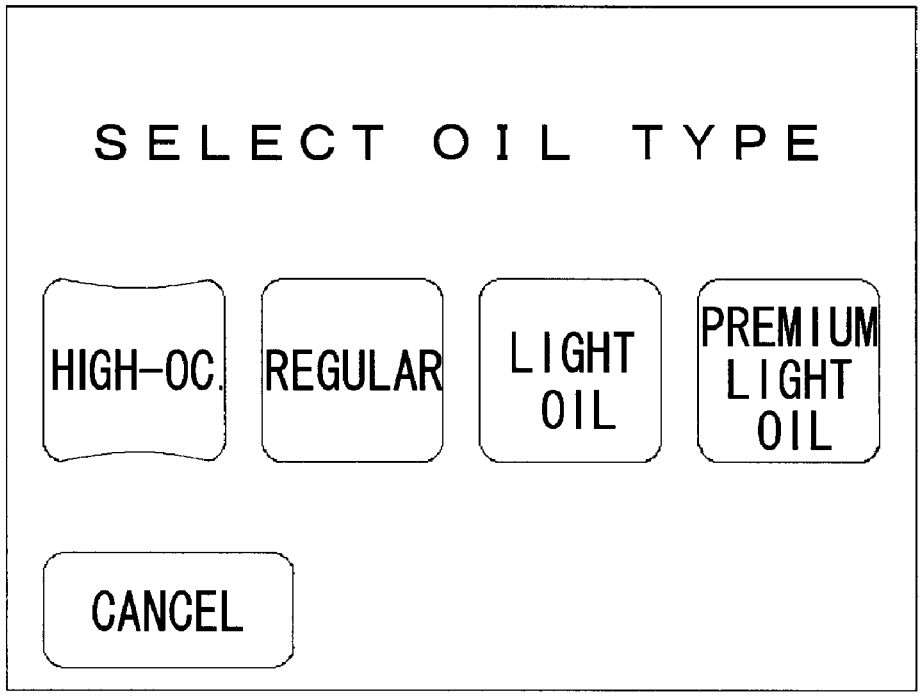
FIG. 7 is an exemplary illustration of a deformed configuration of a selected button in the oil type selection image frame according to the embodiment of the invention.

Next, as a client has come to stand in front of the oil supply apparatus 10, a human body is detected by the human body sensor 31 and an operation is confirmed by the operation confirming means 42, when the image frame selecting means 45 selects from the guide image frame storing means 44 a welcome image frame for a color indication of letters "WELCOME" with an illustration such as of a woman, to be displayed on the touch-panel indicator 27 by the indicator driving means 47. Moreover, in accord with this image frame, a voice such as "welcome" is selected from the guide voice storing means 48 by the guide voice selecting means 49, to be output from the speaker 26 by the voice driving means 50. Thereafter, likewise, as another operation is confirmed by the operation confirming means 42, a voice guide in accord with the image frame is output from the speaker 26, while detail description thereof is omitted. After lapse of a constant display time of the welcome image frame, there is displayed an oil type selection image frame to be such a setup image frame as shown in FIG. 6. This oil type selection image frame has, under a letter phrase "SELECT OIL TYPE", rectangular buttons indicated relatively large to show a high-octane gasoline, a regular gasoline, a light oil, and a premium light oil, and a cancel button, while as an image frame for the background one of a plurality of wall paper image frames stored in the guide image frame storing means 44 is selected by the random number generation means 46 of the image frame selecting means 45 and displayed on the touch-panel indicator 27 by the indicator driving means 47. Once the selected wall paper image frame is given, the same is to be used later on in the screen up to a finish of setup. As any oil type select button is pressed in the oil type selection image frame, the operation is confirmed by the operation confirming means 42, causing the lamp driving means 43 to turn on a lamp 25 of a selected oil type and a lamp 35 of a corresponding nozzle, whereas if the cancel button is pressed, the display returns via the welcome image frame again to the oil type selection image frame. It is noted that any button, if pressed, has a deformed button configuration to be displayed with an increased visibility of selection of the button, as shown in FIG. 7. This is similar in image frames described later.

Figure 8:
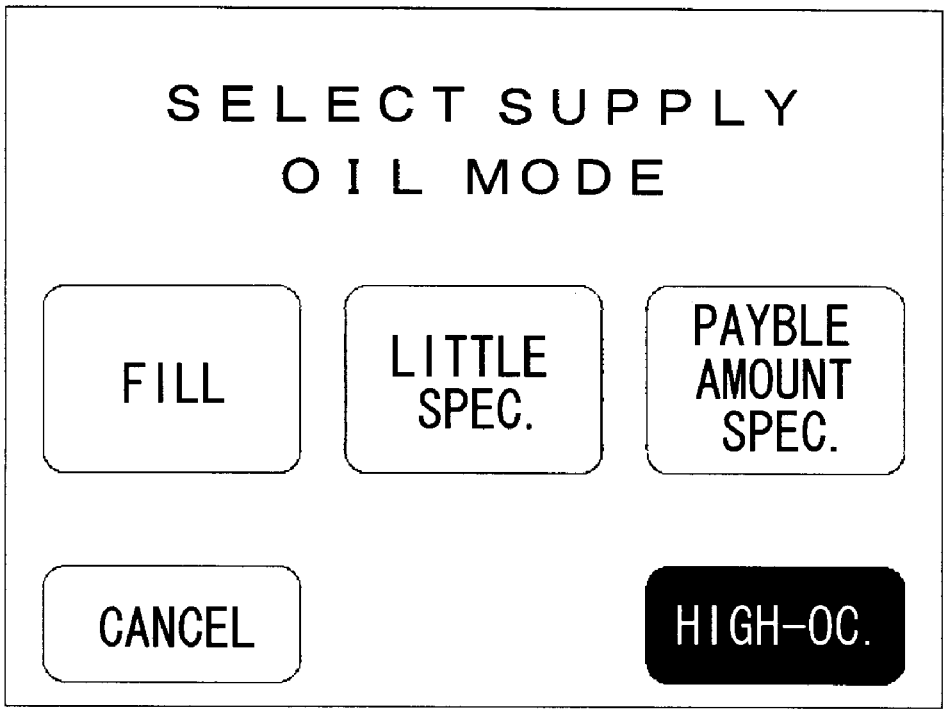
FIG. 8 is an exemplary illustration of an image frame in selection of an oil supply mode according to the embodiment of the invention.
Figure 9:
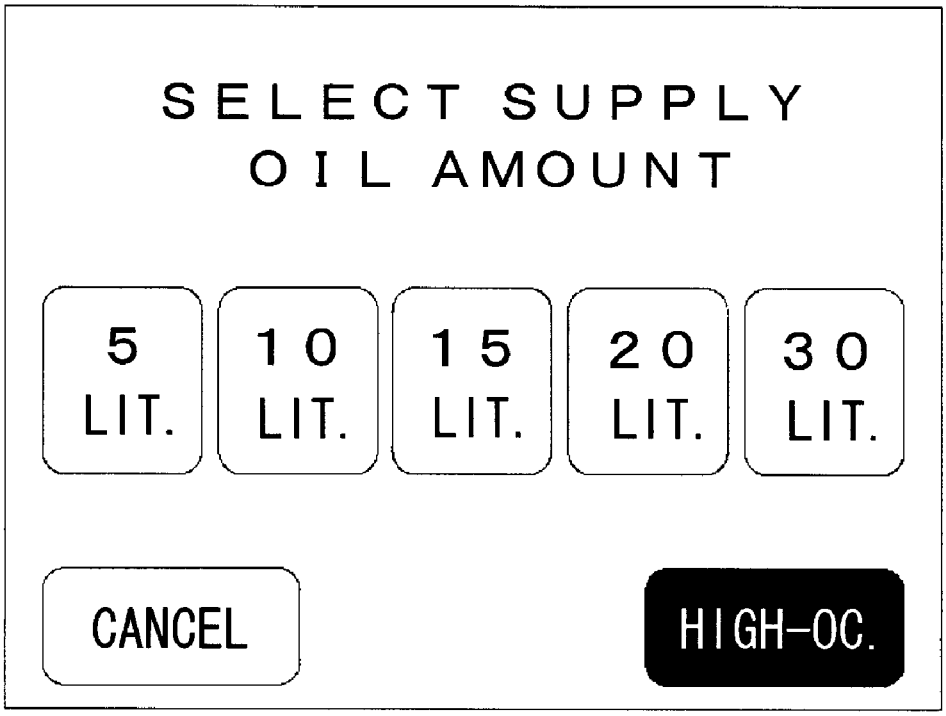
FIG. 9 is an exemplary illustration of an image frame in selection of a little specifying mode according to the embodiment of the invention.
Figure 10:
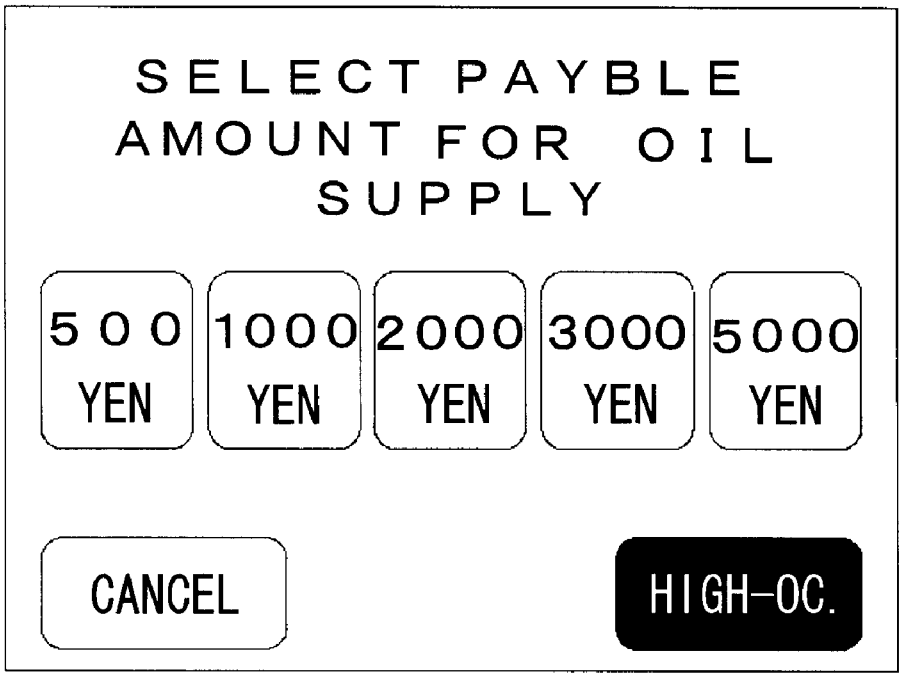
FIG. 10 is an exemplary illustration of an image frame in selection of a payable amount specifying mode according to the embodiment of the invention.

Next, as an oil type is selected in the oil type selection image frame, there is displayed an oil supply mode selection image frame to be such a setup image frame as shown in FIG. 8. This oil supply mode selection image frame has the above-selected wall paper image frame as a background image frame thereof, and under a letter phrase "SELECT OIL SUPPLY MODE", rectangular buttons indicated relatively large to show a fill of tank, a litter specification, and a money amount specification, and a cancel button, in addition to a letter indication of the selected oil type, such as "HIGH-OC.". As the litter specification or money amount specification button is pressed in the oil supply mode selection image frame, there is displayed a litter specification image frame or money amount specification image frame, respectively. If the fill button is pressed, there is displayed a later-described oil supply setup confirmation image frame. If the cancel button is pressed, the display returns to the oil type selection image frame. The litter specification image frame is an image frame for selection of a specified quantity of oil to be supplied in litter, and as a setup image frame such as shown in FIG. 9 has therein buttons of 5 lit., 10 lit. 15 lit., 20 lit., and 30 lit., and a cancel button, in addition to a letter indication of the selected oil type, such as "HIGH-OC.". If any litter button is pressed in the litter specification image frame, there is displayed a subsequent oil supply setup confirmation image frame. If the cancel button is pressed, the display returns to the oil supply mode selection image frame. The money amount specification image frame is an image frame for selection of an oil quantity payable by a specified amount of money, and as a setup image frame such as shown in FIG. 10 has therein buttons of 500 Yen, 1000 Yen, 2000 Yen, 3000 Yen, and 4000 Yen, and a cancel button, in addition to a letter indication of the selected oil type, such as "HIGH-OC.". If any money amount button is pressed in the money amount specification image frame, there is displayed a subsequent oil supply setup confirmation image frame. If the cancel button is pressed, the display returns to the oil supply mode selection image frame.

Figure 11:
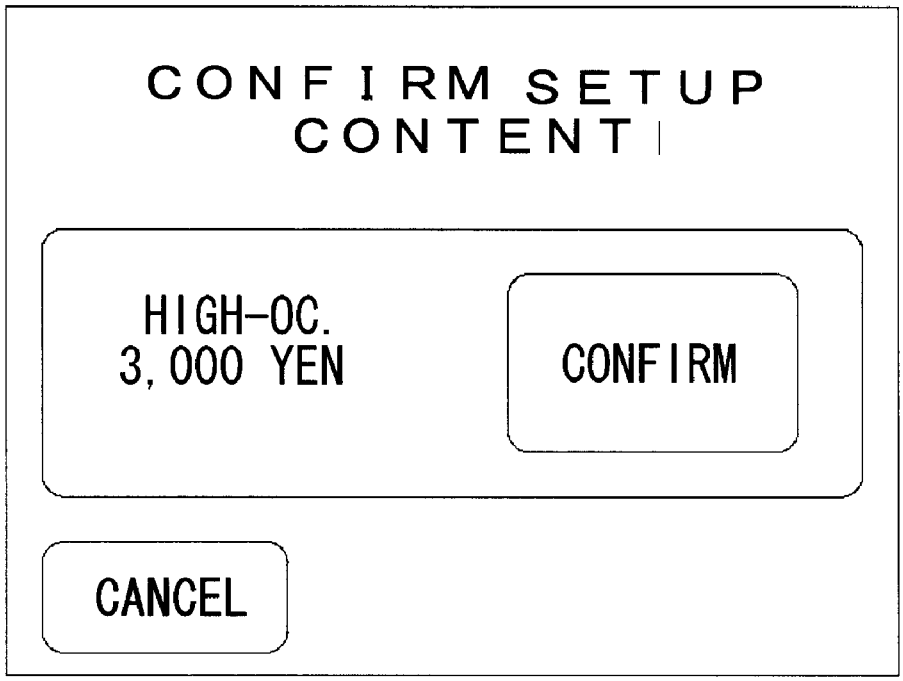
FIG. 11 is an exemplary illustration of an oil supply setup confirmation image frame according to the embodiment of the invention.

Next, as an oil supply mode is selected, there is displayed an oil supply setup confirmation image frame to be such an image frame as shown in FIG. 11. This oil supply setup confirmation image frame is an image frame for confirmation of a selected item in a previous setup image frame, and has, under a letter phrase "CONFIRM SETUP CONTENT", letter indications of selected "HIGH-OC." and "3000 Yen" and a button of confirmation neighboring thereto, in addition to a cancel button. If the confirmation button is pressed in the oil supply setup confirmation image frame, there is displayed a subsequent payment mode selection image frame. If the cancel button is pressed, the display returns to the oil type selection image frame, to again perform selections of an oil type and an oil supply mode.

Figure 12:
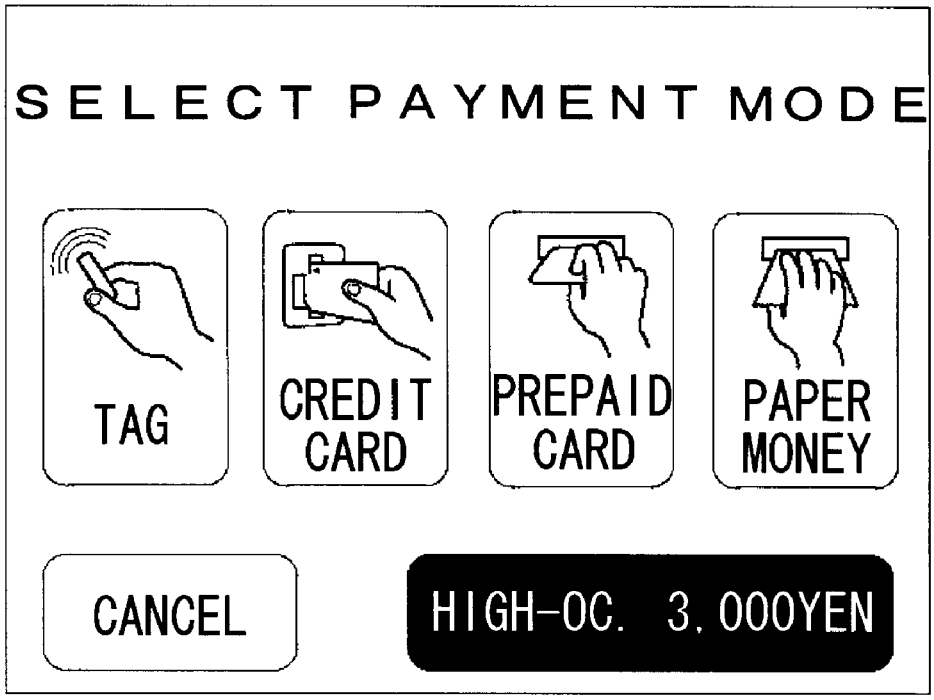
FIG. 12 is an exemplary illustration of a payment mode selection image frame according to the embodiment of the invention.

Next, as the confirmation of an oil supply setup is finished, there is displayed a payment mode selection image frame to be such a setup image frame as shown in FIG. 12. This payment mode selection image frame is an image frame for selection of a mode for payment of a charge of oil supply, and has, under a letter phrase "SELECT PAYMENT MODE", buttons with letters indicating a tag, credit card, prepaid card, and paper money and illustrations indicating conditions of their use, and a cancel button, in addition to letter indications of selected "HIGH-OC." and money amount "3000 Yen". If any button for selection of payment mode is pressed in the payment mode selection image frame, there is displayed a corresponding selection image frame. If the cancel button is pressed, the display returns to the oil type selection image frame, to again perform selections of an oil type and an oil supply mode, and confirmation of an oil supply setup.

Figure 13:
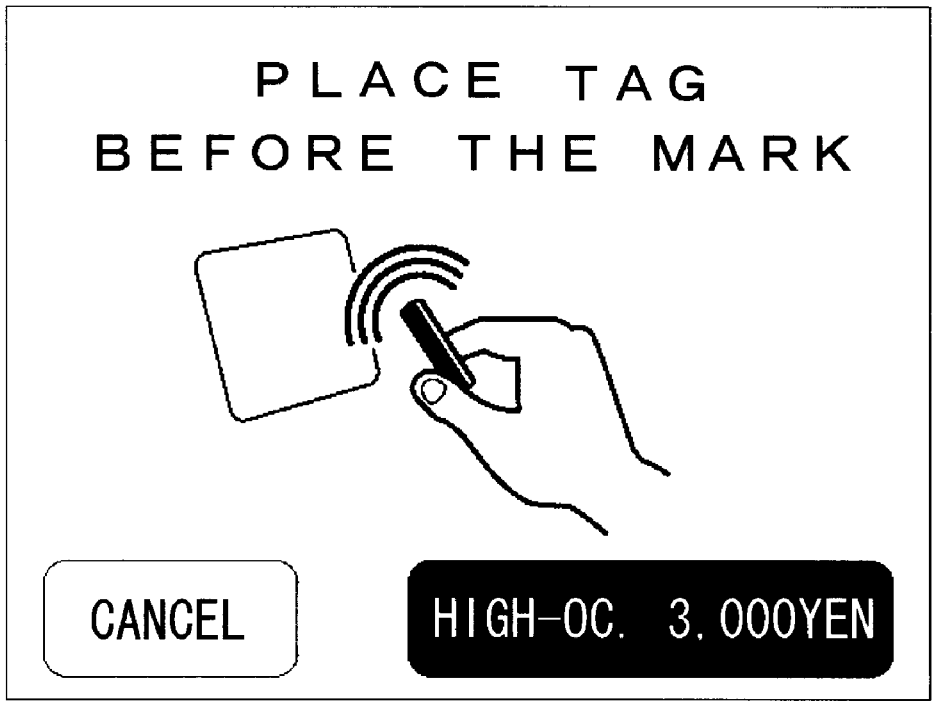
FIG. 13 is an exemplary illustration of an image frame in selection of a tag mode according to the embodiment of the invention.
Figure 14:
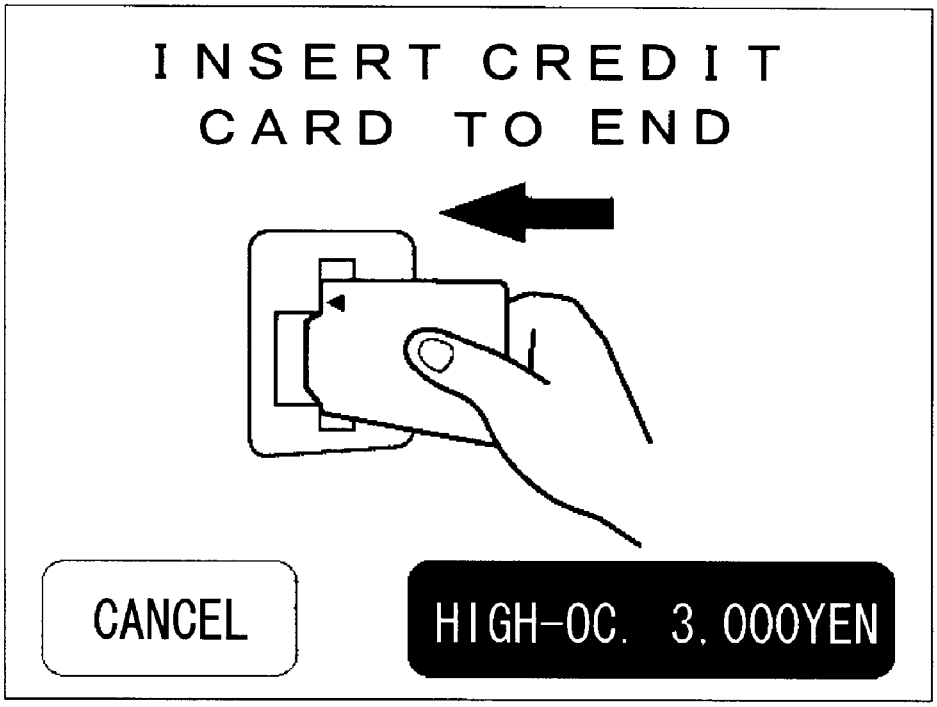
FIG. 14 is an exemplary illustration of an image frame-1 in selection of a credit card mode according to the embodiment of the invention.
Figure 15:
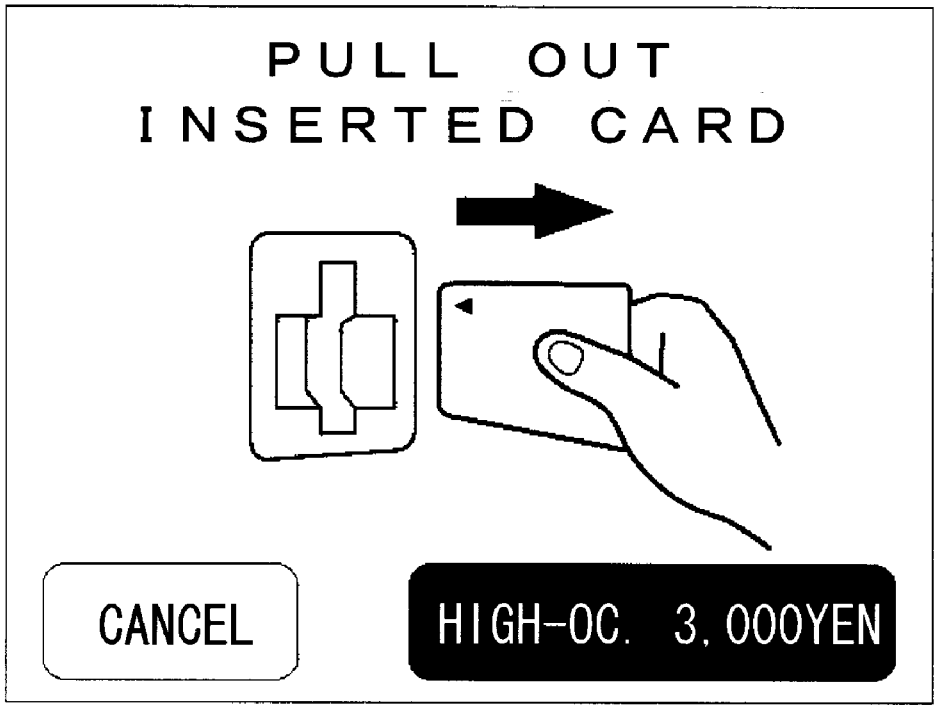
FIG. 15 is an exemplary illustration of an image frame-2 in selection of the credit card mode according to the embodiment of the invention.
Figure 16:
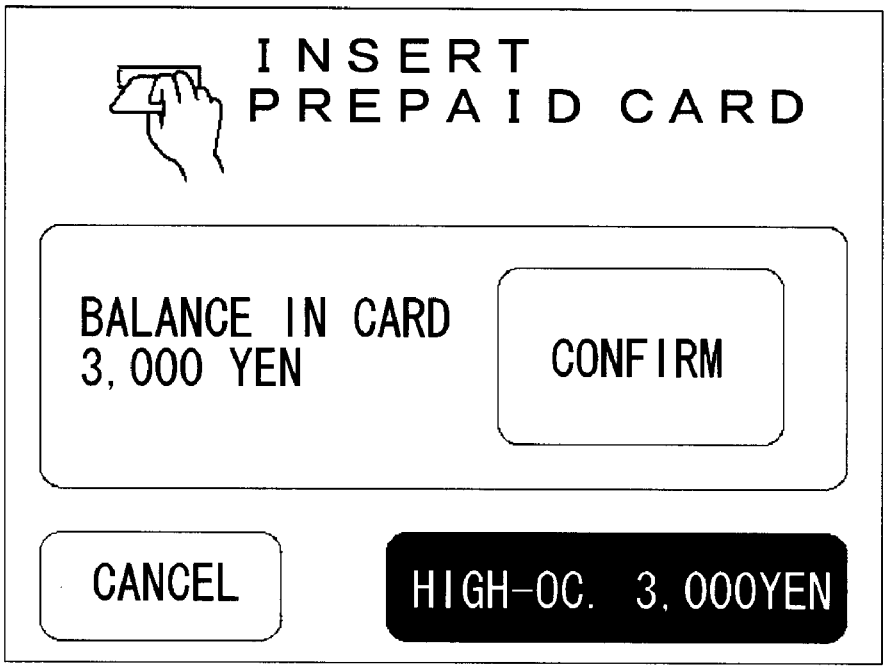
FIG. 16 is an exemplary illustration of an image frame in selection of a prepaid card mode according to the embodiment of the invention.
Figure 17:
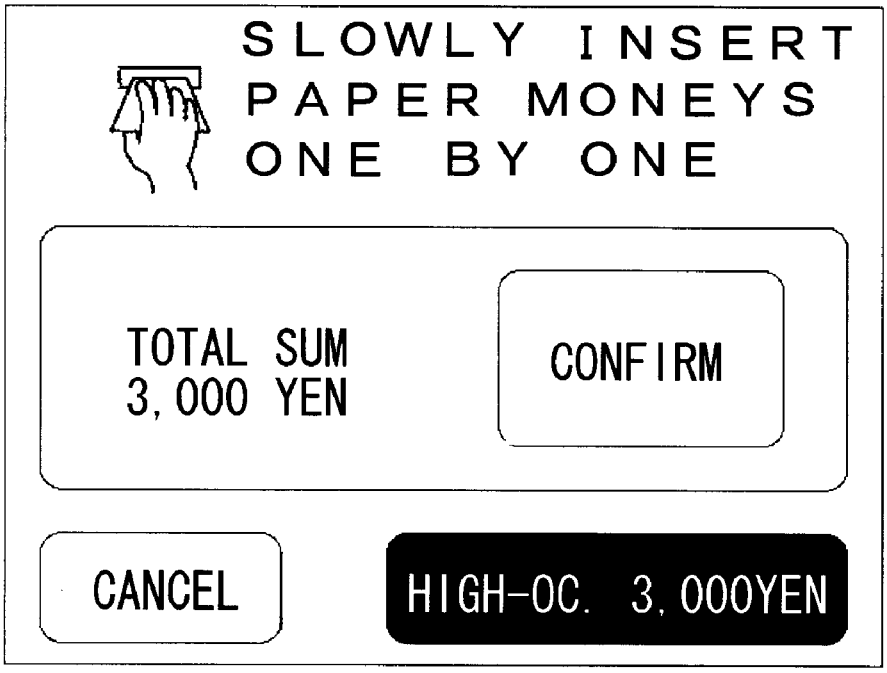
FIG. 17 is an exemplary illustration of an image frame in selection of a paper money mode according to the embodiment of the invention.

If the tag button is selected in the payment mode selection image frame, there is displayed such an image frame as shown in FIG. 13. This tag selection image frame has a letter phrase "PLACE TAG BEFORE THE MARK", an illustration describing a condition of its use, and a cancel button, in addition to letter indications of selected "HIGH-OC." and money amount "3000 Yen". Following this image frame, if a tag is placed before the tag reader 29, then data is read therefrom, allowing for payment of an oil supply charge. As the operation is confirmed by the operation confirmation means 42, there is displayed the next nozzle selection image frame. If the cancel button is pressed, the display returns to the payment mode selection image frame. In case the credit card is selected, there are sequentially displayed such an image frame-1 and an image frame-2 as shown in FIG. 14 and FIG. 15, respectively. The credit card selection image frame-1 has a letter phrase "INSERT CREDIT CARD TO END", an illustration describing a condition of its use, and a cancel button, in addition to letter indications of selected "HIGH-OC." and money amount "3000 Yen". Following this image frame-1, if a credit card is inserted into the card reader 30, then the image frame-2 is displayed in sequence. If the cancel button is pressed, the display returns to the payment mode selection image frame. The credit card selection image frame-2 has a letter phrase "PULL OUT CREDIT CARD", an illustration describing a condition of its use, and a cancel button, in addition to letter indications of selected "HIGH-OC." and money amount "3000 Yen". Following this image frame-2, if the credit card is pulled out of the card reader 30, then the operation is confirmed by the operation confirming means 42, and the next nozzle selection image frame is displayed. If the cancel button is pressed, the display returns to the payment mode selection image frame. In case the prepaid card is selected, there is displayed such an image frame as shown in FIG. 16. This prepaid card selection image frame has a letter phrase "INSERT PREPAID CARD", an illustration describing a condition of its use, letter indications "CARD BALANCE" and "3000 Yen" as read results of insertion, a confirmation button, and a cancel button, in addition to letter indications of selected "HIGH-OC." and money amount "3000 Yen". Following this prepaid card selection image frame, if the confirmation button is pressed, then the next nozzle selection image frame is displayed. If the cancel button is pressed, the display returns to the payment mode selection image frame. In case the paper money is selected, there is displayed such a paper money selection image frame as shown in FIG. 17. This paper money selection image frame has a letter phrase "SLOWLY INSERT PAPER MONEYS ONE BY ONE", an illustration describing a condition of its use, letter indications "SUM AMOUNT" and "3000 Yen" as read results of insertion to the paper money insert part 33, a confirmation button, and a cancel button, in addition to letter indications of selected "HIGH-OC." and money amount "3000 Yen". Following this paper money selection image frame, if the confirmation button is pressed, then the next nozzle selection image frame is displayed. If the cancel button is pressed, the display returns to the payment mode selection image frame.

Figure 18:
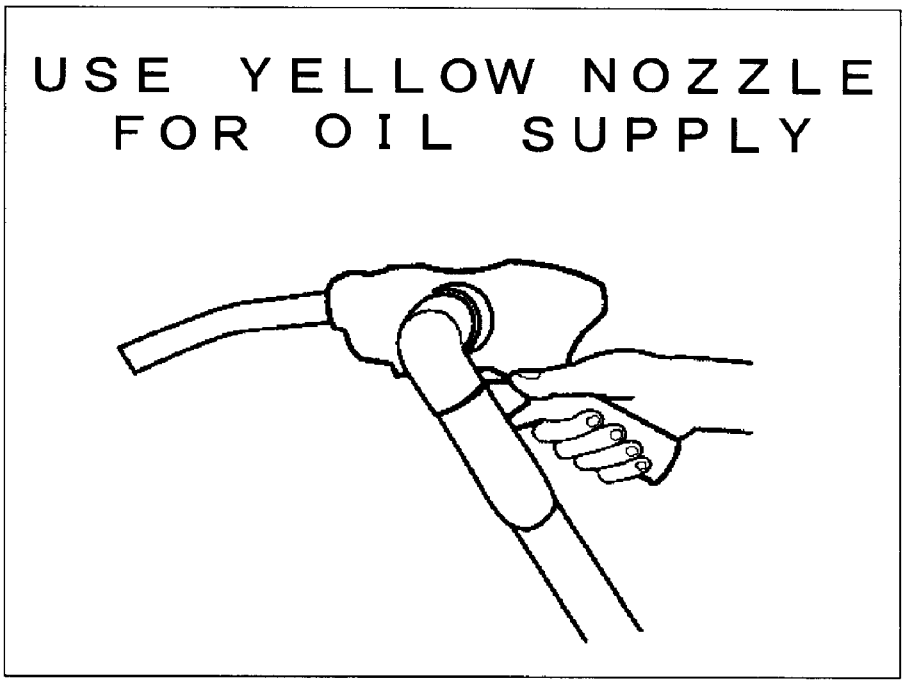
FIG. 18 is an exemplary illustration of a nozzle selection image frame according to the embodiment of the invention.
Figure 19:
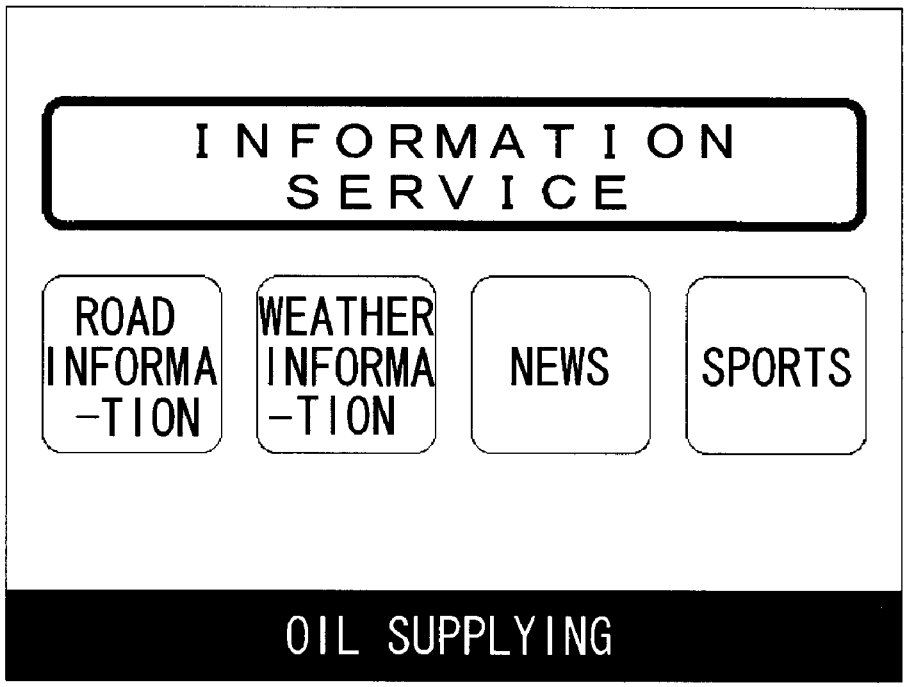
FIG. 19 is an exemplary illustration of an oil supplying image frame according to the embodiment of the invention.

Next, as the payment mode is finished, the nozzle selection image frame is displayed, as shown in FIG. 18. This nozzle selection image frame has a letter phrase "USE YELLOW NOZZLE FOR OIL SUPPLY", and an illustration indicated with an oil supply nozzle in hand, as it is colored. Following this indication, when the oil supply nozzle 18 at a lit nozzle lamp 35 is removed from the nozzle hanger 19, this nozzle operation is detected by the nozzle switch 20 and confirmed by the operation confirming means 42, and there is displayed an oil supplying image frame as a selection image frame shown in FIG. 19. This oil supplying image frame has, under a letter indication "INFORMATION SERVICE", buttons indicated with letters of road information, weather information, news, and sports, and thereunder, a letter indication of "OIL SUPPLYING". If any of those buttons is pressed, there is displayed corresponding service information during the oil supply. Concrete examples of this service information is omitted.

Figure 20:
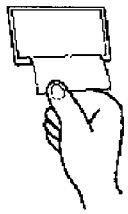
FIG. 20 is an exemplary illustration of an oil supply finishing image frame according to the embodiment of the invention.
Figure 21:
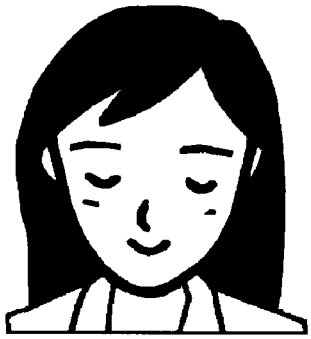
FIG. 21 is an exemplary illustration of a thanking image frame according to the embodiment of the invention.

Next, after the oil supply is finished, as oil supply nozzle 18 is hung on the nozzle hanger 19, this operation is confirmed by the operation confirming means 42, and there is displayed such an oil supply finish image frame as shown in FIG. 20. This oil supply finish image frame has a letter phrase "OIL SUPPLY IS FINISHED, RECEIVE SLIP", an illustration indicating a condition in which a receipt of the printer 28 is taken by hand, and a lower letter indication "25.8 LIT. HIGH-OC. GASOLINE FOR 3000 YEN, SUPPLIED". After lapse of a constant time during which the oil supply finish image frame was kept displayed, there is displayed such a subsequent thank image frame as shown in FIG. 21. This thank image frame indicates a letter phrase "THANK YOU, WAITING FOR NEXT USE" with an illustration such as of a woman. After lapse of a constant time during which the thank image frame was kept displayed, the display retuens to an initial image frame, entring a subsequent waiting condition.

In the oil supply station system 1 of the arrangement described, in the case of oil supply payable in cash by the oil supply apparatus 10 of the oil supply station, because a change is printed by the printer 28 as a record such as by a bar code on an oil supply slip, the bar code can be read by the reader 6*c* of the change payer 6 disposed near the buidling 3 of the office of the oil supply station, allowing, by communication with the POS terminal 5, for collation realtive to a relationship with an oil supply apapratus 10 having rendered the oil supply service to discharge a necessary change from the paper money discharge part 6*f* and/or coin discharge part 6*g*. It therefore is possible to eliminate the need of provision of a plurality of change payers at or near the respective oil supply appartuses 10, with a reduced installation cost, allowing for the oil supply apparatuses 10 to be improved in operability without increase in complexity, as well as for a monitoring to be performed by a few workers in the building 3 of the office.

Moreover, the oil supply guiding apparatus 40 of the above-noted arrangement is provided with the touch-panel indicator 27 attached to the body case 11 of the oil supply apparatus 10 that has an oil supply self-service mechanism adapted for clients to perform as their own services an oil supply setup and oil supply work, and the human body sensor 31 attached to the body case 11 for detecting a client, so that by a detection signal of the human body sensor 31, as it is confirmed by the operation confirming means 42 of the oil supply guide controller 41, the touch-panel indicator 27 can be controlled to start an indication in which setup image frames with setup items each respectively provided with a select button are sequentially indicated by confirmation of operation, with a voice guide from the speaker 26 in correspondence to the setup image frame, thereby allowing for an oil supply guide to be clearly indicated every setup item at a single point, with an increased visibility of an operation button and facilitated confirmation. Still more, the select button of a setup image frame indicated on the touch-panel indicator 27 has a deformed button configuration to indicate a selection when pressed, whereby the operation confirmation is facilitated. Yet more, the touch-panel indicator 27 has a plurality of still images randomly selected to be indicated thereon one by one at intervals of a constant time during an oil supply waiting period before oil supply or after oil supply, whereby the indication is attractive even before or after oil supply. Yet more, the touch-panel indicator 27 has, as a background of a setup image frame indicated thereon, one of a plurality of wall paper image frames randomly selected by the random number generating means 46 of the image frame selecting means 45, to be indicated up to an end of the oil supply setup, allowing for setup image frames to be indicated without wearing.

It is noted that the oil supply apparatus 10 may be of any self-service type adapted for oil supply of at least a plurality of oil types. Further, the touch-panel indicator may preferably be of a large size, with operation buttons and the like to be large as well, so that the visibility is enhanced. Image frames in the embodiment are illustrative, and can be modified in an arbitrary manner, without limitation thereto.

As will be seen from the following detailed description, according to the present invention, there can be eliminated the need of provision of a plurality of change payers, with a reduced installation cost, allowing for oil supply apparatuses to be improved in operability without increase in complexity, as well as for a monitoring to be performed by a few workers in a building of an office. Further, an oil supply guiding apparatus is provided with a touch-panel indicator attached to a body case of an oil supply apparatus that has an oil supply self-service mechanism adapted for clients to perform as their own services an oil supply setup and oil supply work, and a human body sensor attached to the body case for detecting a client, so that by a detection signal of the human body sensor the touch-panel indicator can be controlled to start an indication in which setup image frames with setup items each respectively provided with a select button are sequentially indicated by confirmation of operation, thereby allowing for an oil supply guide to be clearly indicated every setup item at a single point, with an increased visibility of an operation button and facilitated confirmation.

What is claimed is:

1. An oil supply station system comprising:

a plurality of oil supply apparatuses standing within a site of an oil supply station, and each respectively having at a body case thereof an oil supply mechanism adapted for a client to render as own services an oil supply setup and oil supply work, and a touch-panel indicator for indicating an oil supply guide, and having a printer for recording a change on an oil supply slip for oil supply payable in cash;

a change payer disposed in a vicinity of a building of an office of the oil supply station, for reading the oil supply slip to discharge a change; and a POS terminal connected in a data communicatable manner with the plurality of oil supply apparatuses and the change payer, for providing a discharge permission of the change to the change payer.

2. An oil supply station system according to claim 1, wherein the body case of a respective oil supply apparatus has a human body sensor attached thereto for detecting the client, the touch-panel indicator being adapted to start indication in response to a detection signal of the human body sensor, and an oil supply guiding apparatus is provided to be adaptive by operation confirmation for a sequential indication of setup image frames having a select button disposed every setup item.

3. An oil supply station system according to claim 2, wherein the select button of a setup image frame indicated on the touch-panel indicator has a deformed button configuration to indicate a selection when pressed.

4. An oil supply station system according to claim 2, further comprising a speaker for a voice guide to be performed in correspondence to a setup image frame indicated on the touch-panel indicator.

5. An oil supply station system according to claim 2, wherein the touch-panel indicator has a plurality of still images randomly selected to be indicated thereon one by one at intervals of a constant time during an oil supply waiting period before oil supply or after oil supply.

6. An oil supply station system according to claim 2, wherein the touch-panel indicator has, as a background of a setup image frame indicated thereon, one of a plurality of wall paper image frames randomly selected to be indicated up to an end of the oil supply setup.

* * * * *